US011779119B1

(12) United States Patent
Goldman

(10) Patent No.: US 11,779,119 B1
(45) Date of Patent: Oct. 10, 2023

(54) FOLDING CHAIR WITH USER INTERCHANGEABLE FRAME AND COAT RACK ADAPTED FOR HANGING ON A WALL

(71) Applicant: Beth Metsch Goldman, Cherry Hills Village, CO (US)

(72) Inventor: Beth Metsch Goldman, Cherry Hills Village, CO (US)

( * ) Notice: Subject to any disclaimer, the term of this patent is extended or adjusted under 35 U.S.C. 154(b) by 0 days.

(21) Appl. No.: 17/736,361

(22) Filed: May 4, 2022

Related U.S. Application Data

(60) Provisional application No. 63/192,653, filed on May 25, 2021.

(51) Int. Cl.

| | |
|---|---|
| ***A47C 4/04*** | (2006.01) |
| ***A47C 1/126*** | (2006.01) |
| ***A47C 9/06*** | (2006.01) |
| ***A47C 4/08*** | (2006.01) |
| ***A47C 13/00*** | (2006.01) |
| ***G09F 15/00*** | (2006.01) |

(52) U.S. Cl.
CPC ..... *A47C 4/04* (2013.01); *A47C 1/126* (2013.01); *A47C 4/08* (2013.01); *A47C 9/06* (2013.01); *A47C 13/00* (2013.01); *G09F 15/0062* (2013.01)

(58) Field of Classification Search
CPC .. A47C 4/04; A47C 1/126; A47C 4/08; A47C 9/06; A47C 13/00; G09F 15/0062
USPC ..... 297/16.1, 16.2, 23, 56, 58, 118, 129, 297/188.04, 188.06, 217.1
See application file for complete search history.

(56) References Cited

U.S. PATENT DOCUMENTS

| | | | | |
|---|---|---|---|---|
| 3,603,656 | A * | 9/1971 | Ferman | A47D 11/002 297/440.13 |
| 5,328,232 | A * | 7/1994 | Whitehead | A47C 4/14 297/50 |
| 6,089,651 | A * | 7/2000 | Carmen | A47C 4/20 297/14 |
| 6,896,322 | B1 * | 5/2005 | Foy | A47C 9/06 297/14 |
| 7,328,942 | B1 * | 2/2008 | Wu | A47C 4/24 297/183.5 |
| 11,348,493 | B2 * | 5/2022 | Wriedt | G09F 15/0012 |
| 2009/0183409 | A1 * | 7/2009 | Thomas | G09F 15/0062 40/610 |
| 2014/0291460 | A1 * | 10/2014 | Warncke | A47C 9/06 29/428 |
| 2015/0272336 | A1 * | 10/2015 | Abelmann | A47C 11/00 297/188.07 |

(Continued)

*Primary Examiner* — Robert Canfield
(74) *Attorney, Agent, or Firm* — GUGLIOTTA & GUGLIOTTA LPA

(57) ABSTRACT

A flat folding chair system is provided incorporating additional functionality. The folding chair, when collapsed, is retained on pegs protruding from an affixed wall plate. The rear portion of the chair is adapted to removably secure a support panel onto which artwork, marker board, or the like may be mounted. When the chair is in the folded position, the chair can be hung on a wall, where the artwork, or the like, can be displayed. In this manner, the folding chair serves as a decorative, or other useful, wall hanging when the chair is not in use. Further, when the chair is removed and opened to function as seating, the pegs may be available for use as a coat rack.

18 Claims, 11 Drawing Sheets

(56) References Cited

U.S. PATENT DOCUMENTS

| | | | | |
|---|---|---|---|---|
| 2017/0188712 | A1* | 7/2017 | Ehlinger | A47C 7/543 |
| 2019/0392738 | A1* | 12/2019 | Topcuoglu | G09F 15/0062 |
| 2021/0212469 | A1* | 7/2021 | Black | A47C 4/12 |

* cited by examiner

FOLDING CHAIR WITH USER INTERCHANGEABLE FRAME AND COAT RACK ADAPTED FOR HANGING ON A WALL

RELATED APPLICATIONS

The present invention claims benefit of U.S. Provisional Application No. 63/192,653, filed on May 25, 2021, and incorporated by reference as if fully rewritten herein.

BACKGROUND OF THE INVENTION

1. Field of the Invention

The present invention relates generally to folding chairs and, more particularly, to a folding chair that, when not in use, can be hung on a wall and adapted for alternative uses.

2. Description of the Related Art

Folding chairs are well known and typically used in a home or other venue for optional expanded seating abilities. Folding chairs are typically stored when not in use, and brought out when needed, for example during large gatherings. When not in use, folding chairs take up storage space, which can be in short supply in smaller spaces.

Current storage solutions include simply stowing the chairs away in a closet or storage area or hanging chairs on a wall. To minimize storage space, some chairs are designed to stack as shown in FIG. 1, or nest as shown in FIG. 2. And, others are adapted to fold flat, as shown in FIG. 3.

Hanging a chair on a wall may save storage space, but a chair hanging on a wall is often bulky and/or unsightly. One solution for this problem is to simply turn the chair itself into art, by printing artwork on the chair itself. For example, a German company Ambivalenz markets the "Flapps" chair, which is offered with a variety of preprinted artwork. The Flapps chair however is limited to preprinted designs, printed on the chair itself, and does not take into account an individual's personal style or taste.

Consequently, a need has been felt for providing a flat folding chair that can be hung on a vertical surface and that also incorporates an auxiliary function while being so stored.

SUMMARY OF THE INVENTION

It is thus an object of the present invention to provide a folding chair adapted for hanging on a wall.

It is another object of the present invention to provide such a hangable folding chair that is adapted for alternative uses.

It is a feature of the present invention to provide a folding chair adapted for hanging on a wall in concert with a peg rack or peg rail to receive the folding chair.

It is another feature of the present invention to provide the folding chair and peg rack or peg rail combination wherein the folding chair is further adapted as a built-in art frame or other functional element.

Briefly described according to present invention, a flat folding chair is provided that overcomes various limitations of the prior art. The folding chair, when collapsed, serves as a fully functioning support frame that can be hung on a wall and adapted for a variety of decorative or useful purposes. In one form, the chair of the present invention has one or more holes which are adapted to be hung on one or more corresponding support pegs that are secured to a wall. Another storage problem created by large gatherings is storage space for guests' accessories, such as coats and handbags. During a large gathering the chairs can be removed from the wall pegs for use, and the wall pegs are free to serve as hooks for hanging guest coats and handbags. It should be understood that the present invention is not limited to use with art, or the activities explicitly disclosed herein, but can be employed with a variety of entertainment or artistic options. In the preferred embodiment, the rear portion of the chair is adapted to receive artwork or the like. When the chair is in the folded position, the chair can be hung on a wall, where the artwork, or the like, can be displayed. In this manner, the folding chair serves as a decorative, or other useful, wall hanging when the chair is not in use.

It is an advantage of the present invention to provide a folding chair with an adaptable frame for receiving art or the like.

It is another advantage of the present invention that when not in use, and in the folded position, the folding chair can be hung on a wall to display the art.

It is yet another advantage of the present invention for the folding chair to be adapted for other wall-mountable activities such as a dartboard, marker board, drawing board or the like.

Further objects, features, elements, and advantages of the invention will become apparent in the course of the following description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
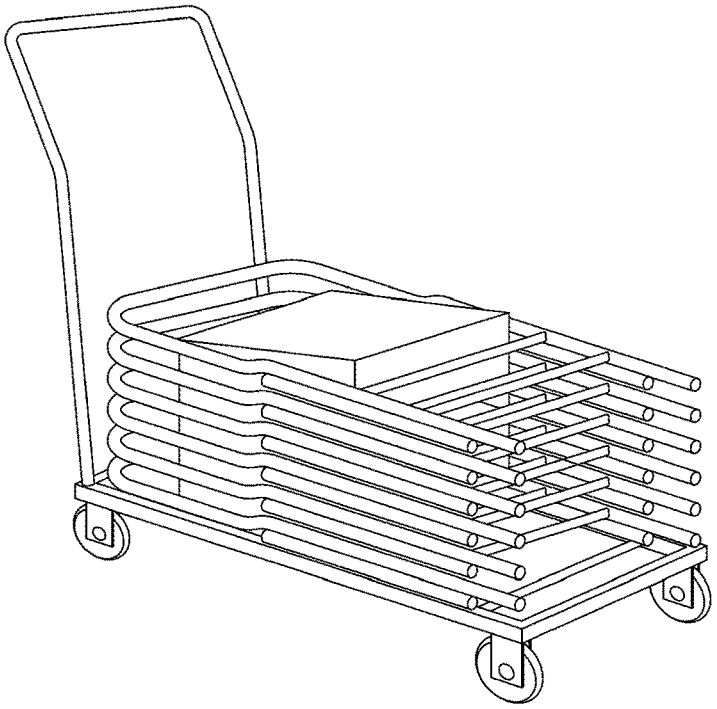
FIG. 1 PRIOR ART
FIG. 1 is a graphic representation of an exemplary stacking chair according to the PRIOR ART.
Figure 2:
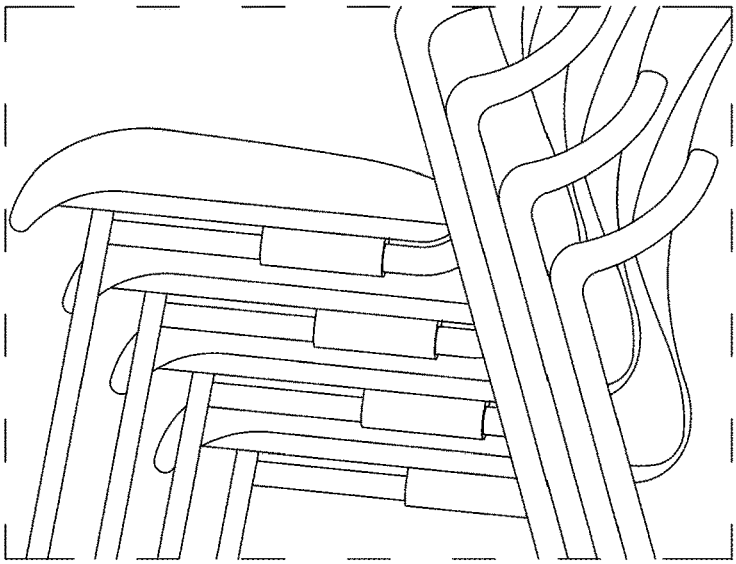
FIG. 2 PRIOR ART
FIG. 2 is a graphic representation of an exemplary nesting stacking chair according to the PRIOR ART.
Figure 3:
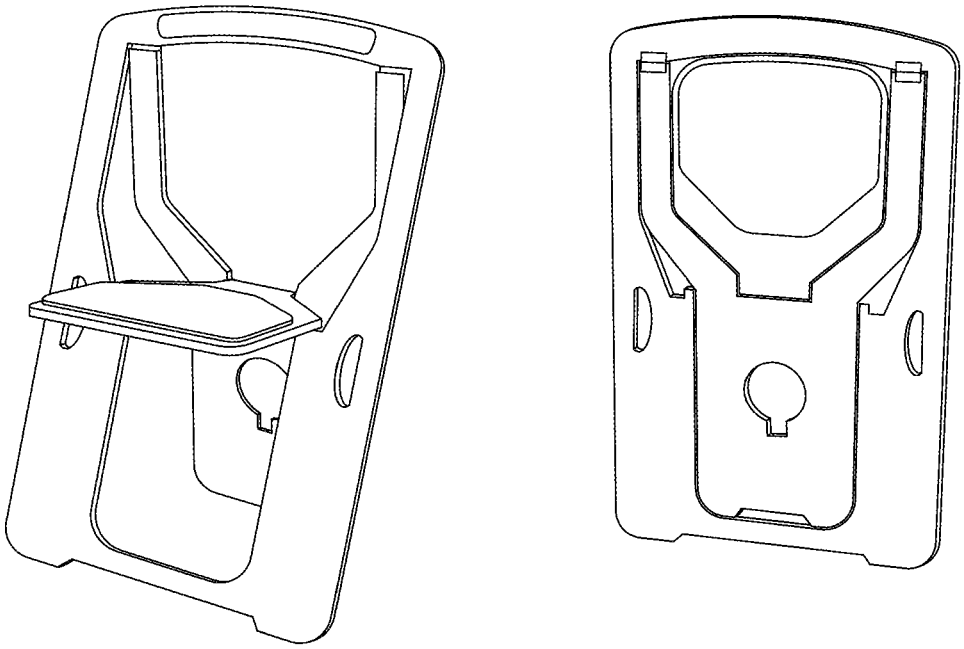
FIG. 3 PRIOR ART
FIG. 3 is a graphic representation of an exemplary fold flat chair according to the PRIOR ART.

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

For purposes of the present disclosure the terms "a" and "an" herein do not denote a limitation of quantity, but rather denote the presence of at least one (1) of the referenced items. Further for purposes of the present disclosure the terms "in", "out", "left" "right", "up" or "down" are all spatial and functionally relative directions used to aid in the description to best explain the principles of the invention and its practical application, and to aid others skilled in the art to best utilize the invention and are not meant to be limiting to any particular orientation. It should also be understood that, unless a term is expressly defined in this patent there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, which is done for sake of clarity only so as to not confuse the reader, and it is not intended that such claim term by limited, by implication or otherwise, to that single meaning. Finally, unless a claim element is defined by reciting the word "means" and a function without the recital of any structure, it is not intended that the scope of any claim element be interpreted based on the application of 35 U.S.C. § 112(f).

1. Detailed Description of the Figures

Referring now to FIG. 4 through FIG. 14, wherein like reference numerals indicate the same parts throughout the several views, a folding chair, generally noted as 10, is shown according to the preferred embodiment of the present invention. The chair 10 preferably has an open position (e.g., FIG. 7-8) and closed position (e.g., FIG. 9-12). The chair 10 may comprise a foldable A-frame support structure 20. The A-frame support structure 20 comprises a top portion opposite a bottom portion. The A-frame support structure 20 further comprises a front portion 35 which comprises the two front legs 21*a*, 21*b* of the chair 10 when in the open position. The A-frame support structure 20 further comprise a back portion which comprises the two back legs 25*a*, 25*b* of the chair when in the open position. The front portion of the support structure comprises a left leg 21*a*, right leg 21*b*, a top support rail 22 and a bottom support rail 23. The back portion of the support structure comprises a left leg 25*a*, right leg 25*b*, a top support rail 26 and a bottom support rail 27.

The front portion and back portions are pivotally attached at the top portion of the A-frame support structure by a hinge 30 or similar apparatus. The hinge 30 may allow the A-frame support structure to be moved between the open and closed positions. As shown best in conjunction with FIG. 11, in the closed position, the front portion and back portions are flush together for a minimal side profile. For purposes of the present invention, a minimal side profile preferably means less than or equal to approximately 3 inches. In a more preferred configuration, the minimal profile is less than or equal to approximately 2 inches. As shown best in conjunction with FIG. 11-12, in the open position the bottom portion of the front and back portions extend apart to form an A-frame.

In the preferred embodiment the front portion is longer than the rear portion such that when the chair 10 is upright and in the open position, the rear portion is near perpendicular to the floor, and the front portion extends at an angle, from the hinge to the floor. In the folded position the bottom rail 27 of the rear portion is nested above and flush with the bottom rail 23 of the front portion.

The top support rail 22 of the front portion is further adapted as a back rest for support. In one embodiment, the top support rail 22 of the front and back portions further form one or more holes 75. The holes 75 may preferably be adapted for hanging the folding chair on a wall or other vertical surface when the chair 10 is in the folded position. The holes 75 are formed in the top support rail 22 of the front portion and top support rail 26 of the back portions such that the holes are aligned such when in the folded position. Each corresponding hole 75 of the front and rear portions align to form a continuous hole that extends through the chair 10.

Figure 13:
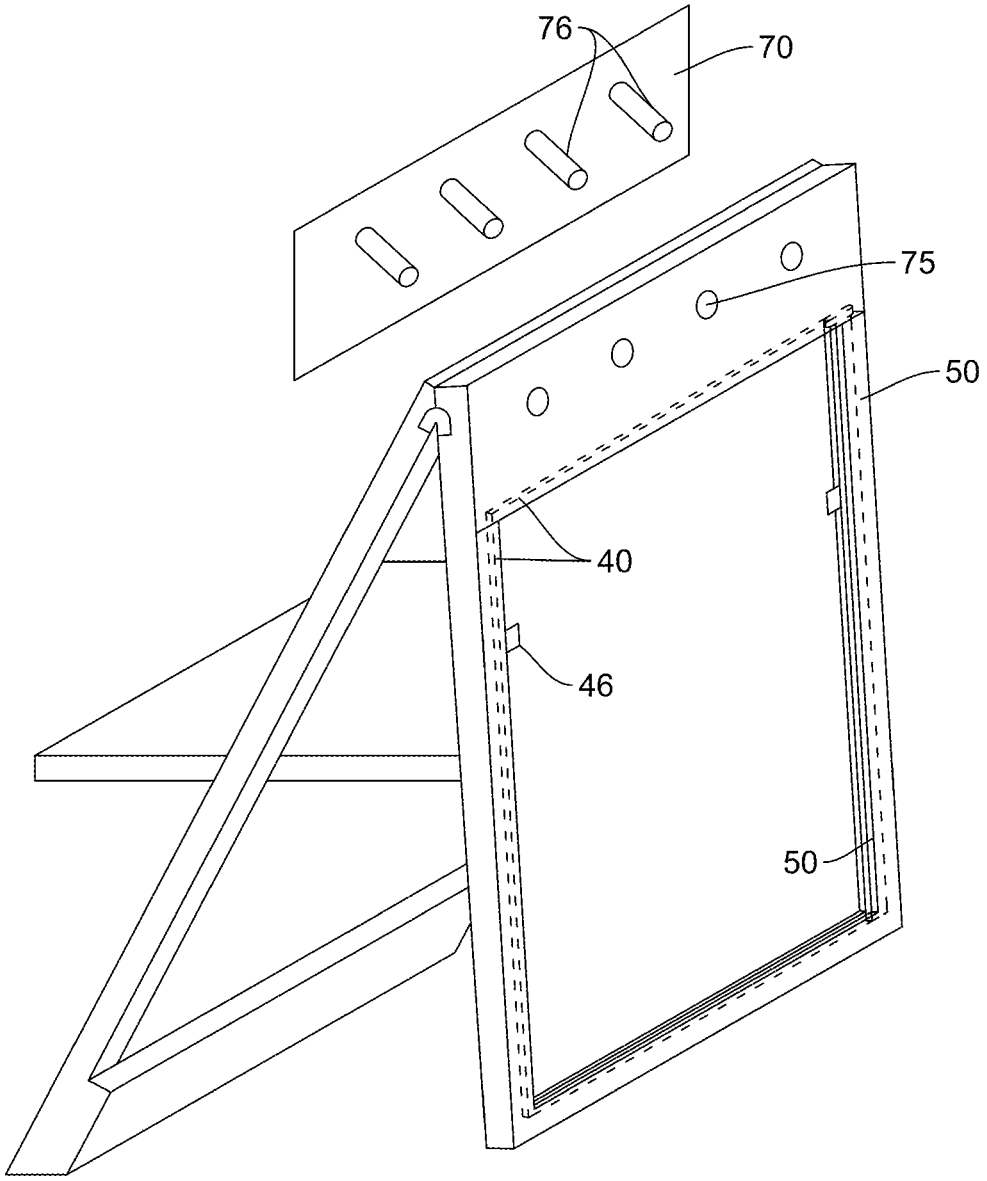
FIG. 13 is a perspective view and labeled schematic, from the rear left side showing the folding chair and wall-mounting plate of the present invention in the open position.
Figure 15:
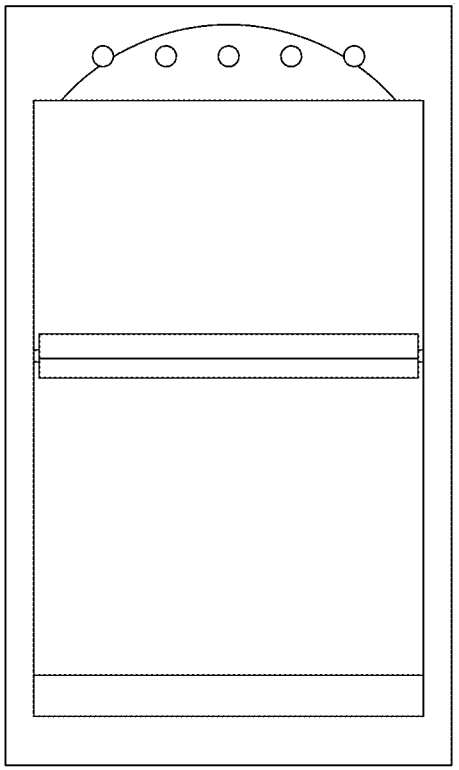
FIG. 15 is a perspective view, from the front right side, showing the folding chair and wall-mounting plate of the present invention in the open position.
Figure 14:
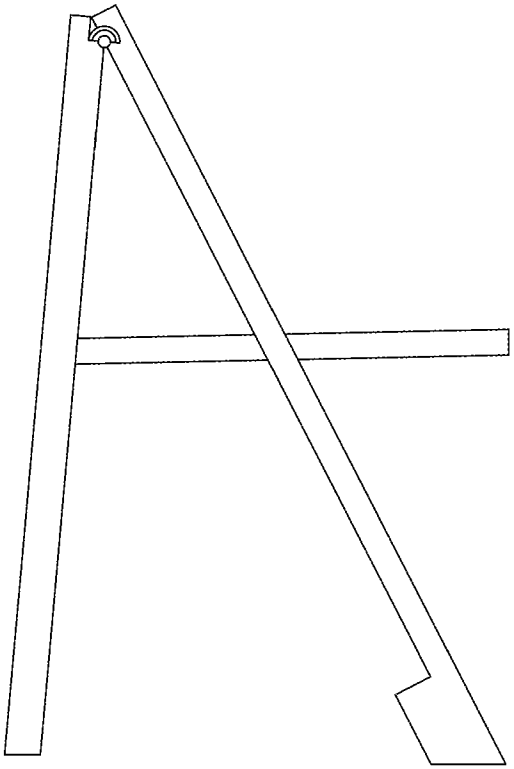
FIG. 14 is a right-side elevation view and schematic showing the folding chair of the present invention in the open position.

As best shown in conjunction with FIG. 13 and FIG. 15, the one or more holes 75 may preferably be adapted to correspond to respective one or more pegs 76 which are mounted to a wall panel 70 forming a "peg rail" or "peg rack", or "hook rack" or functionally similar or equivalent structure. In such a configuration, the wall panel 70 is thereby specifically adapted for hanging the chair 10 to a wall or vertical surface to which the panel 70 is affixed. When the chair 10 is needed and removed from the pegs 76, the pegs 76 can be alternatively used as hooks for hanging items such as coat, jackets, handbags or the like.

The folding chair 10 further comprises a seat portion 60 pivotally attached at or near the middle of the front portion at pivot point 35*a* and slidably attached by a hinge 35*b* to the rear portion. In the folded position the seat portion 60 rotates about pivot point 35*a* to fold flush. In the open portion the seat portion rotates to an open position at or near perpendicular to the rear portion, and horizontal to the floor, when the chair is upright.

Further, a useful or decorative article may be secured to an appropriately sized panel within the front portion. In one preferred embodiment the rear portion of the chair is adapted to receive a frame structure. Such a frame may have an interior portion defined by border 100, typically a rectangle. The border 100 may be defined by the inner edge of each of the two legs 25*a* 25*b*, the top support rail 26, and the bottom support rail 27 of the rear portion. The border 100 may further comprise a track 40 in the inner edge of each of the two legs, the top support rail, and the bottom support rail of the rear portion.

Figure 4:
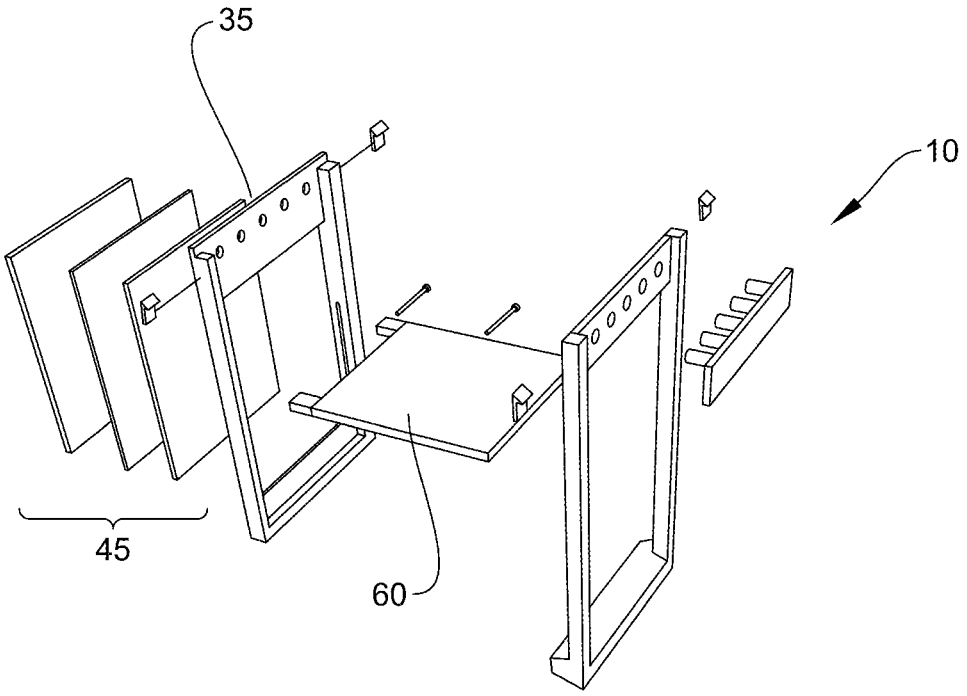
FIG. 4 is an exploded perspective view of a folding chair with built-in art frame and pegged rack adapted for hanging on a wall according to a preferred embodiment of the present invention.
Figure 5:
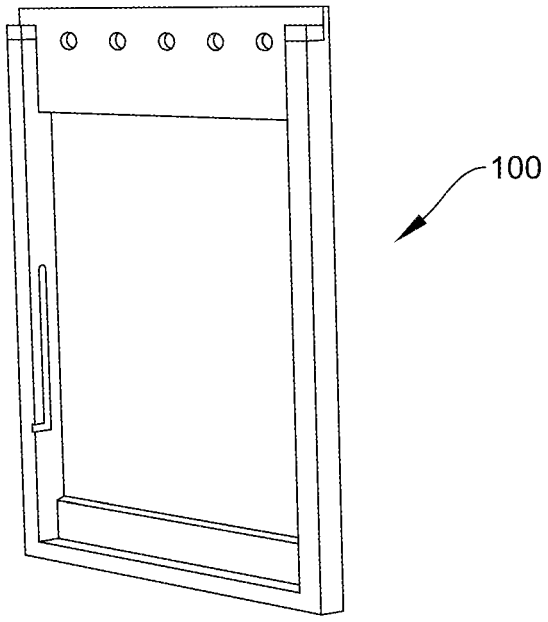
FIG. 5 is a perspective view of a border 100 for use therewith.
Figure 6:
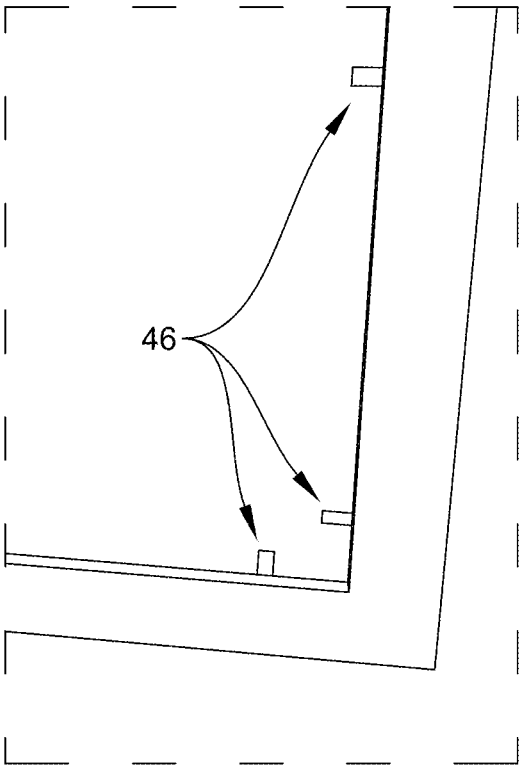
FIG. 6 is a partial detailed view of a preferred attachment mechanism 46 for the support panel 45 for use therewith.
Figure 7:
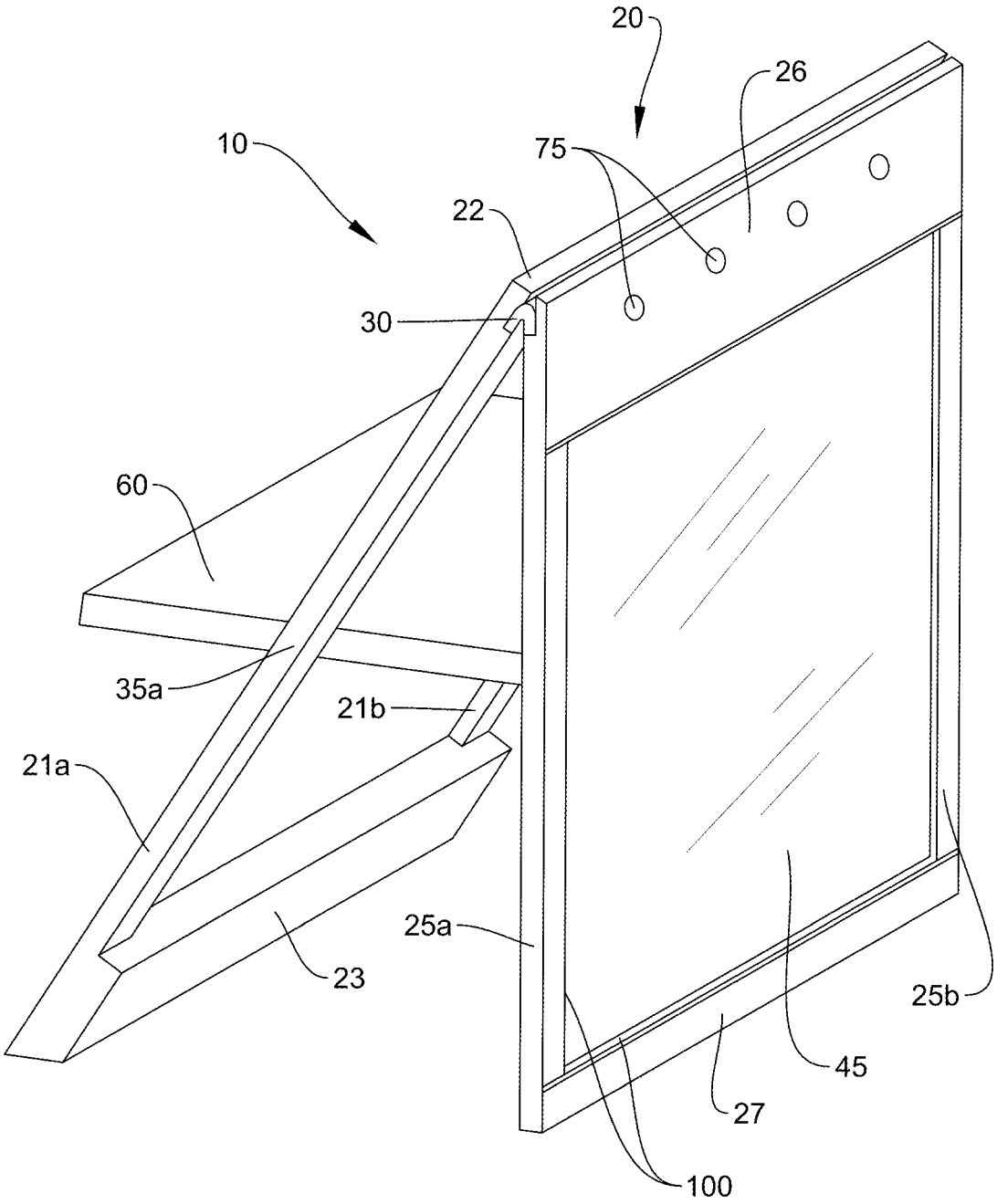
FIG. 7 is a perspective view, from the rear-left side, showing the folding chair of the present invention in an alternate embodiment shown with the seat in the open position.
Figure 8:
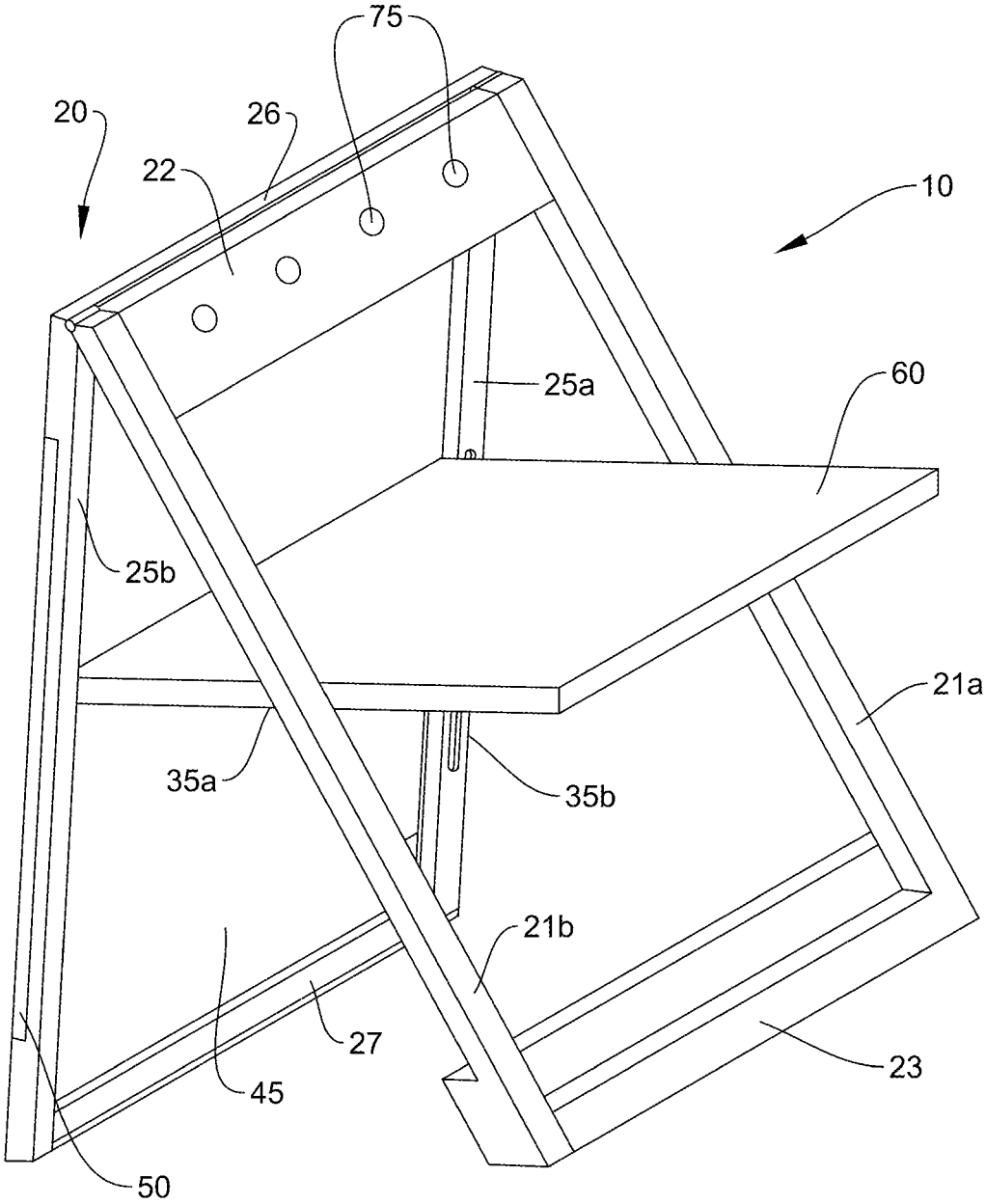
FIG. 8 is a perspective view, from the front right side, showing the folding chair of FIG. 7 shown with the seat in the open position.
Figure 9:
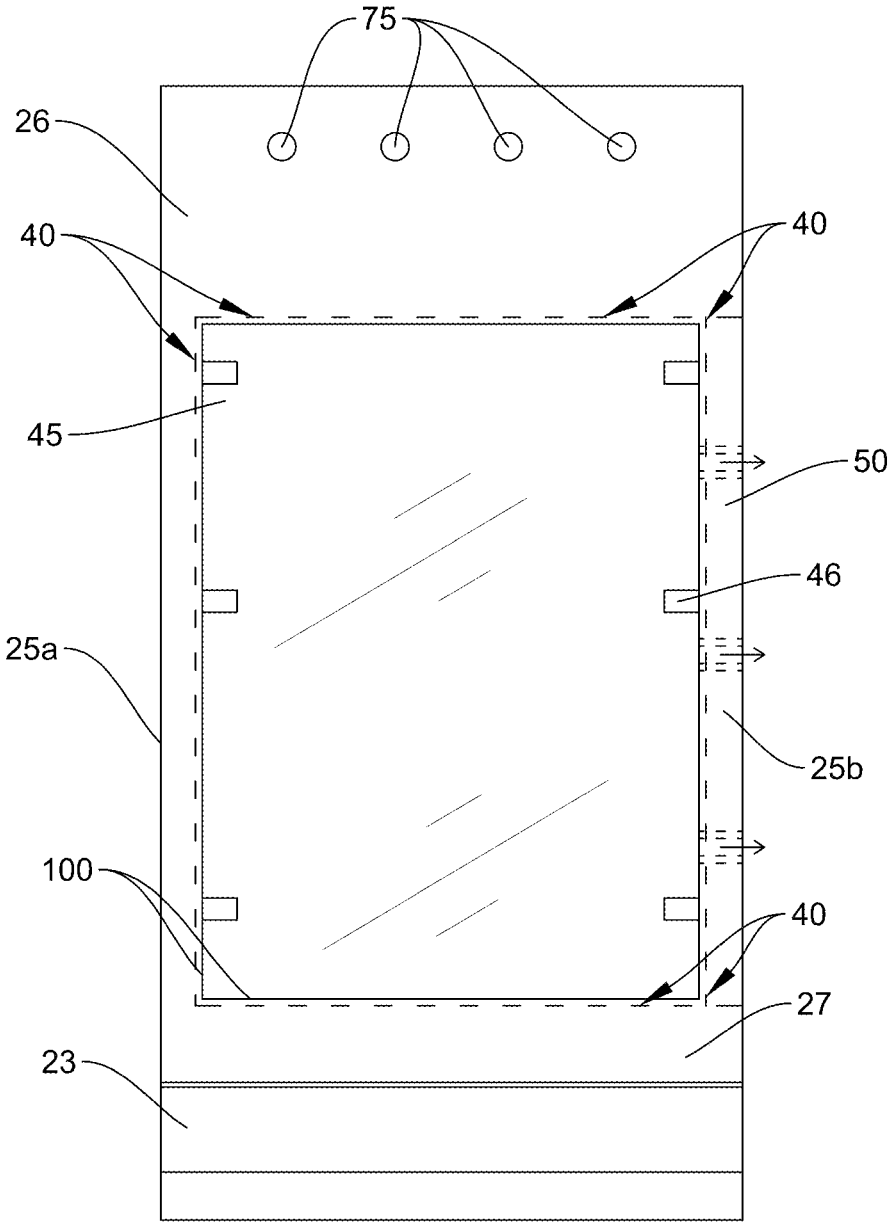
FIG. 9 is a rear elevation view showing the folding chair of the present invention in the closed position, shown with either alternate attachment mechanism for the support panel 45.
Figure 10:
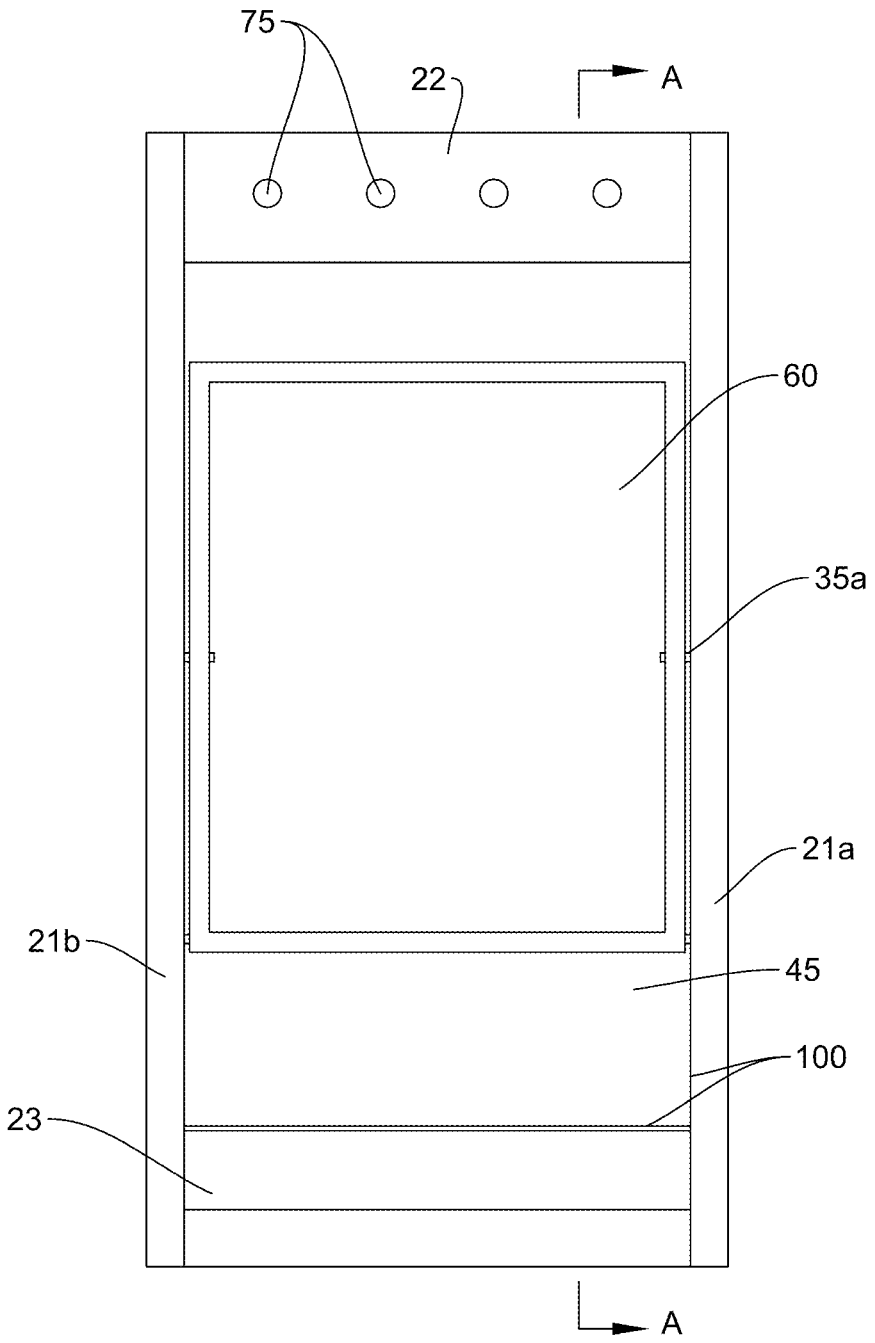
FIG. 10 is a front elevation view showing the folding chair of the present invention in the closed position.
Figure 11:
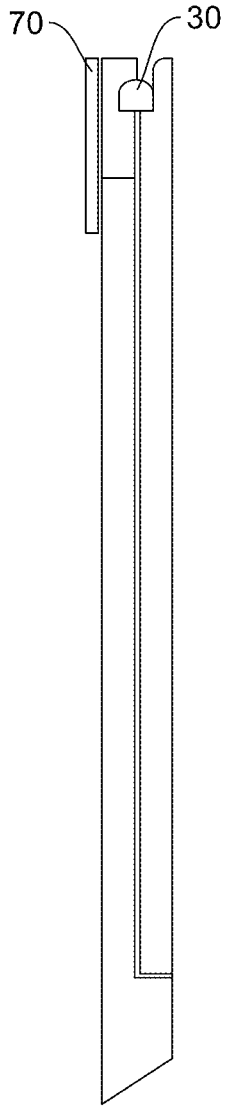
FIG. 11 is a left-side elevation view showing the frame of the folding chair of the present invention in the closed position.
Figure 12:
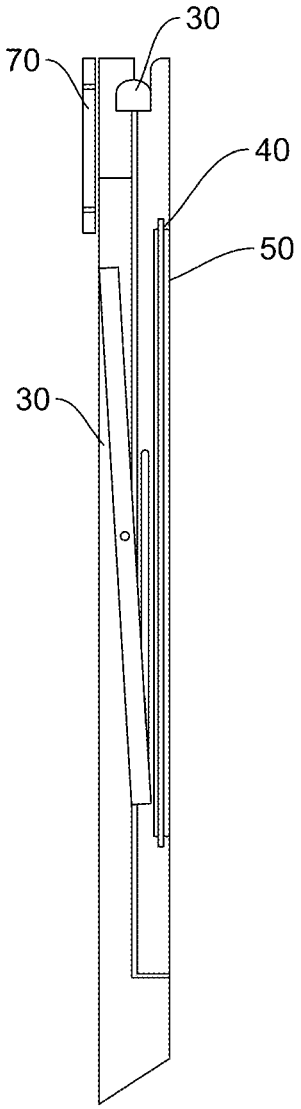
FIG. 12 is a left-side sectional view thereof taken along a medial centerline.

As best shown in conjunction with FIG. 4 through FIG. 6, the support panel 45 may be affixed within the boarder 100 in a removable manner. In a preferred embodiment, a series of retention tabs 46 may be supported within the frame 100 and extending inwardly in a manner that impinges against the back side of the support panel 45. The retention tabs 45 may be removable or bendable such as to be capable of being moved from an impingement location to allow the support panel 45 to be removed. In an alternate configuration, as best shown in conjunction with FIG. 7 through FIG. 9. The track 40 may form a groove adapted to slidably receive a rigid or semi-rigid support panel 45 for art or the like. At least one leg 25*a* or 25*b* of the rear portion may comprise a removable side rail 50. When such a side rail 50 is removed, the track 40 of the inner edge of the border of the interior portion may be exposed and accessible. A rigid or semi-rigid rectangular support panel 45 may preferably have dimensions slightly larger than the perimeter dimensions of the border 100, and as such is adapted to slide into the grooves of the track 40 along the perimeter. In such a configuration when the side rail 50 is removed, the grooves of track 40 are accessible, and the user can slide the panel 45 into (or out of) the frame. Once the panel 45 is in place, the removable side rail 50 may be secured back in place, and the panel 45 is secured in the frame.

It is anticipated that other attachment mechanisms may be configured to provide that functionally similar or equivalent to secure the panel 45 in a removable manner. In any such embodiment, the support panel 45 to allow for a functional or aesthetic reconfiguration. The panel 45 may comprise one or two sheets of plexiglass, or other clear material for securing artwork or posters. Artwork may be secured by tape or other securing mechanisms to a single panel. The artwork may alternately be secured between two panels. The plexiglass panel or panels may then be inserted into the frame 100 and secured via the retention tabs 46 (preferred embodiment), or slid into the grooves 50 (alternate embodiment), thereby allowing the artwork to be displayed. It is intended and should be apparent to those having ordinary skill in the relevant art and in light of the present teachings, that the artwork component may be alternately replace with any useful or decorative article that may be secured to an appropriately sized panel 45. For example, the panel 45 may support an aesthetic element in one such configuration, or support a picture, artwork or other aesthetic element in an alternate configuration. Similarly, a dart board, cork board, calendar, or drawing board (such as chalk or dry-erase), may be equivalently secured to the middle of a rigid or semi-rigid panel 45. In this way, a variety of inserts may be provided that can be customized by a user or marketed as pre-made inserts for the folding chair.

2. Operation of the Preferred Embodiment

In operation, a chair 10 of the present invention may be used for seating when needed in a portable manner as with otherwise conventional folding chairs. However, when the folding chair 10 is not in use, it may be hung on a wall or vertical surface where the wall panel 70 is affixed. Additional, both the wall panel 70 and the chair 10 are adapted for alternative uses. The pegs 76 of the wall panel 70 may be used has a coat rack or similar or equivalent hanger when the chair 10 is removed. When the chair 10 is replaced, it is folded flat in a manner that has a low profile so as to lay flat against the wall or vertical surface in an unobtrusive manner, where is may remain until needed but will still provide an alternative function, such as a decor, dart board, marker board, etc. For purposes of the present invention the term "alternate function" is intended to be broadly and liberally construed to incorporate any similar or equivalent functionality as described herein, as well as more broadly so as not to only be limiting to a functionality specifically illustrated.

In operation such a hangable folding chair minimizes the amount and type of storage space necessary, which may be convenient for smaller spaces (i.e., small rooms, apartments, etc.) while still providing the primary functionality of a folding chair when required.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples, and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of *Warner-Jenkinson Company*, v. *Hilton Davis Chemical,* 520 US 17 (1997) or *Festo Corp.* v. *Shoketsu Kinzoku Kogyo Kabushiki Co.,* 535 U.S. 722 (2002), or other similar caselaw or subsequent precedent should not be made if any future claims are added or amended subsequent to this Patent Application.

What is claimed is:

1. A chair and chair hanger combination comprising:

a folding chair having an open seating position and a closed storage position, the folding chair further comprising:

an A-frame support structure comprises a top portion opposite a bottom portion;

a front portion comprising a left front leg, a right front leg, a first top support rail and a first bottom support rail;

a back portion comprising a left back leg, a right back leg, a second top support rail and a second bottom support rail;

a hinge pivotally attaching the front portion and the back portion at the top portion, whereby the hinge moves between the open seated position and the closed storage position; and the chair hanger comprises a panel mountable to a vertical surface and adapted for hanging the chair in a flat, flush manner to the vertical surface; and an auxiliary function member affixed to or formed by a second panel within the back portion.

2. The chair and chair hanger combination of claim 1, wherein the front portion and the back portions are flush together when in the closed storage position.

3. The chair and chair hanger combination of claim 2, wherein the bottom rail of the back portion is nested above and flush with the bottom rail of the front portion when in the closed storage position.

4. The chair and chair hanger combination of claim 1, wherein the first top support rail is further adapted as a back rest.

5. The chair and chair hanger combination of claim 1, wherein:

the chair hanger further comprises at least one supporting structure extending cantilever from a front face of the panel; and at least one hole formed by the first top support rail and the second top support rail, said at least on hole for receiving a supporting structure, wherein holes formed in the first top support rail and the second top support rail are aligned such when in the folded position.

6. The chair and chair hanger combination of claim 5, wherein said at least one supporting structure is selected from a group consisting of: pegs and hooks.

7. The chair and chair hanger combination of claim 1, wherein said auxiliary function member is selected from a group consisting of: artwork; decor; cork board; calendar; drawing board; chalk board; and dry-erase board.

8. The chair and chair hanger combination of claim 1, wherein said front portion further forms a slide-in frame structure for receiving or retaining the second panel.

9. The chair and chair hanger combination of claim 1, wherein frame structure has an interior portion defined by border, said border forming an inner track, the border being defined by an inner edge of each of the two rear legs and/or the second top support rail, and the second bottom support;

wherein the inner track forms a groove adapted to receive the second panel.

10. The chair and chair hanger combination of claim 7, wherein the second panel is removable so that different auxiliary function members are inserted.

11. The chair and chair hanger combination of claim 3, wherein the first top support rail is further adapted as a back rest.

12. The chair and chair hanger combination of claim 3, wherein:

the chair hanger further comprises at least one supporting structure extending cantilever from a front face of the panel; and at least one hole formed by the first top support rail and the second top support rail, said at least on hole for receiving a supporting structure, wherein holes formed in the first top support rail and the second top support rail are aligned such when in the folded position.

13. The chair and chair hanger combination of claim 12, wherein said at least one supporting structure is selected from a group consisting of: pegs and hooks.

14. The chair and chair hanger combination of claim 3, wherein said auxiliary function member is selected from a group consisting of: artwork; decor; cork board; calendar; drawing board; chalk board; and dry-erase board.

15. The chair and chair hanger combination of claim 3, wherein said front portion further forms a slide-in frame structure for receiving or retaining the second panel.

16. The chair and chair hanger combination of claim 14, wherein the second panel is removable so that different auxiliary function members are inserted.

17. The chair and chair hanger combination of claim 3, wherein frame structure has an interior portion defined by border, said border forming an inner track, the border being defined by an inner edge of each of the two rear legs, the second top support rail, and the second bottom support; wherein the inner track forms a groove adapted to slidably receive the second panel.

18. The chair and chair hanger combination of claim 14, wherein the second panel is removable so that different auxiliary function members are inserted.

* * * * *